US012571309B2

(12) United States Patent
Levey

(10) Patent No.: US 12,571,309 B2
(45) Date of Patent: Mar. 10, 2026

(54) DRILL HEAD INJECTION SYSTEM FOR A SELF-DRILLING ROCK BOLT ASSEMBLY

(71) Applicant: OKA Rock Bolt Technologies Pty Limited, Newcastle (AU)

(72) Inventor: Mark Anthony Levey, Newcastle (AU)

(73) Assignee: OKA Rock Bolt Technologies Pty Limited, Newcastle (AU)

( * ) Notice: Subject to any disclaimer, the term of this patent is extended or adjusted under 35 U.S.C. 154(b) by 81 days.

(21) Appl. No.: 18/287,396

(22) PCT Filed: Apr. 27, 2022

(86) PCT No.: PCT/AU2022/050388

§ 371 (c)(1),
(2) Date: Oct. 18, 2023

(87) PCT Pub. No.: WO2022/226592

PCT Pub. Date: Nov. 3, 2022

(65) Prior Publication Data

US 2024/0200452 A1 Jun. 20, 2024

(30) Foreign Application Priority Data

| | | |
|---|---|---|
| Apr. 27, 2021 | (AU) | 2021901240 |
| May 11, 2021 | (AU) | 2021901394 |
| May 17, 2021 | (AU) | 2021901470 |

(51) Int. Cl.

| | |
|---|---|
| ***E21D 20/02*** | (2006.01) |
| ***E21D 20/00*** | (2006.01) |
| ***E21D 21/00*** | (2006.01) |

(52) U.S. Cl.

CPC ..... *E21D 20/028* (2013.01); *E21D 20/003* (2013.01); *E21D 20/026* (2013.01); *E21D 21/0053* (2016.01)

(58) Field of Classification Search

CPC ... E21D 20/028; E21D 20/003; E21D 20/026; E21D 21/0053

See application file for complete search history.

(56) References Cited

U.S. PATENT DOCUMENTS 4,801,008 A * 1/1989 Rich ..... B65D 81/3255 222/137
5,375,947 A * 12/1994 Gouws ..... E21D 20/028 405/269

(Continued)

FOREIGN PATENT DOCUMENTS

WO 2014190382 A1 12/2014
WO 2021006802 A1 1/2021

*Primary Examiner* — Janine M Kreck

(74) *Attorney, Agent, or Firm* — E. Eric Mills; Nicholas P. Stadnyk; Maynard Nexsen PC

(57) ABSTRACT

An injection system for a self-drilling rock bolt assembly (1), the system including: a receptacle (2) to be fixed in use to a drill head (4) of the self-drilling rock bolt assembly (1), the receptacle (2) having a nozzle receiving end (5) and an opening (6) at the other; a replaceable canister (7) to be located within said receptacle (2) in use, said canister (7) adapted to supply two or more substances for use in installing the rock bolt assembly (1) through said nozzle receiving end (5); and a plunger system (8) operatively associated with said receptacle (2) adjacent said opening (6) at said other end and positioned along a longitudinal axis (XX) of the drill head (4); the plunger system (8) including two or more plungers (9) that are activated in use to drive the substances within the canister (7) when located within the receptacle (2), delivering the substances by way of a nozzle (21) mounted to the nozzle receiving end (5) into the self-drilling rock bolt assembly (1).

16 Claims, 14 Drawing Sheets

(56) References Cited

U.S. PATENT DOCUMENTS

| | | | | |
|---|---|---|---|---|
| 6,955,504 | B2 * | 10/2005 | Leibhard | E21D 20/021 405/259.5 |
| 2006/0153645 | A1 | 7/2006 | Rataj et al. | |
| 2010/0230909 | A1 | 9/2010 | Bayer et al. | |
| 2010/0284762 | A1 | 11/2010 | Wieczorek et al. | |
| 2016/0130778 | A1 * | 5/2016 | Levey | E02D 5/801 405/259.1 |

* cited by examiner

DRILL HEAD INJECTION SYSTEM FOR A SELF-DRILLING ROCK BOLT ASSEMBLY

RELATED APPLICATIONS

This application is a 35 U.S.C. § 371 U.S. national phase entry of International Application No. PCT/AU2022/050388 having an international filing date of Apr. 27, 2022, which claims the benefit of Australian Application No. AU2021901240 filed Apr. 27, 2021, Australian Application No. AU2021901394 filed May 11, 2021, and Australian Application No. AU2021901470 filed May 17, 2021, each of which is incorporated herein by reference in its entirety.

FIELD

The present invention relates to a self-drilling rock bolt assembly. In particular, a drill head injection system for a semi or fully automated self-drilling rock bolt assembly to operate on a continuous miner, tunnel boring machine, mobile bolting machine, building/construction bolting into concrete tools or the like.

BACKGROUND

Rock bolts are common throughout the world and are typically drilled into strata and retained therein to provide support to the integrity of the strata which assists with supporting structures. For example, rock bolts can be used to support the strata of mines, tunnels, passageways, canals, enclosures, shafts, halls, access ways, subways or the like.

In underground tunnelling, for example, rock bolts are often installed at progressive intervals along the tunnel. During the construction of the tunnel it is desirable to provide a rock bolt that is easy to secure into the strata with the least human intervention due to the highly hazardous environment.

The most common method of securing a rock bolt to strata is to drill a hole in the strata using a drill rig with a drill rod. Once the hole has been drilled and the drill rod is retracted from the hole, the drill rod is removed from the drill chuck. A bolt is then inserted into a drive dolly which is an adapter between the bolt and drive chuck. A resin capsule is then inserted into the drilled hole. The bolt is then inserted into the drill hole causing the resin capsule to rupture. The bolt is then rotated to promote mixing and dispersion of the resin. Once the resin has set, a nut on the end of the bolt is rotated and the nut comes into contact with the collar of the hole. Torque is applied to the nut on contact with a plate against the collar of the borehole and the nut places tension over the length of the bolt that has not been already anchored to the strata. As a result, the strata is then placed in compression, containing the strata.

The above described bolting method has many steps and involves a high level of manual handling. Repetitive manual handling tasks of this type ultimately lead to accidents and injuries. The speed of installation of a bolt is governed by the proficiency of the operator, and this can vary considerably. Production demands require an efficient installation time for strata support, however, this method takes time due to the many steps involved.

Self-drilling rock bolts were developed to overcome the above disadvantages. They are known for providing a single drilling and securing function. This negates the need to withdraw the drill rod and subsequently insert a resin capsule and a bolt into the hole using various methods of anchoring.

Hollow, steel, self-drilling rock bolt versions have been developed to minimize the number of cycles involved when rock bolting strata. One self-drilling rock bolt utilizes the centre hole of the bolt as the delivery port for water during the drilling process as well as an avenue to pump cement grouts and resins of various sorts to anchor and encapsulate the bolt. The self-drilling rock bolt is then simply filled both internally and externally about the bolt annulus, and therefore provide a dowel support to the strata. No tension is applied to the length of the bolt in the strata.

Mechanically anchored self-drilling rock bolts are also available. They can be used in combination with cement grouts or resins that are inserted post anchoring with the mechanical anchor. However, the mechanical anchor technique can also fail when the surrounding borehole strata is weak and is unable to provide sufficient resistance to allow tensioning. The bolt is heavier than alternate options and the system is also slow due to the post grouting step for full encapsulation.

Another self-drilling rock bolt system utilizes a hollow bar with a chemical resin capsule already placed in the centre of the bar. Water is used as the drill and flush medium and travels through the middle of the bolt. Once the hole is drilled using the bolt, water is delivered into a cavity of the bolt containing the resin capsule. The water forces the resin capsule to disperse and be displaced around the annulus of the bolt. When the fast-chemical resin has set, the bolt has reinforced the strata when tightened with a nut. The disadvantage of this system is that the bolt is very expensive to manufacture due to the internal arrangements within the bolt. Also, each bolt then has a shelf life based on the resin capsule expiration.

In addition to the above disadvantages, existing self-drilling rock bolts, though used throughout the world, are expensive, time consuming to install, heavy, cumbersome and complicated to install correctly. Also, full automation has not yet been widely achieved for installing traditional self-drilling rock bolts. Mechanical anchors, static mixers, individual chemicals, springs and the like also make known self-drilling rock bolt systems non-automatable. Mechanical anchors in soft strata conditions can also fail and therefore won't allow the bolt to be pre-tensioned.

Accordingly, there was a need to provide a rock bolt drill head mechanism, a self-drilling rock bolt, a fluid delivery system and a method for securing the self-drilling rock bolt to strata that separately (or together) provides that the strata is supported quickly, reliably and efficiently, increases worker safety, provides significant automation, can be pre-tensioned, provides a multi-use injection system for use with multiple substances, reduces costs, provides productivity improvements and reduces the amount of human intervention and hence improves safety at an operation site.

The present applicant went some way to achieving these desired characteristics as shown in their International PCT application PCT/AU2014/000558 (WO/2014/190382) the entire disclosure of which is incorporated herein by reference.

SUMMARY

It is an object of the present invention to at least substantially address one or more of the above disadvantages, or at least provide a useful alternative to the previously mentioned rock bolt systems.

In a first aspect the present invention provides an injection system for a self-drilling rock bolt assembly, the system including:

a receptacle to be fixed in use to a drill head of the self-drilling rock bolt assembly, the receptacle having a nozzle receiving end and an opening at the other;

a replaceable canister to be located within said receptacle in use, said canister adapted to supply two or more substances for use in installing the rock bolt assembly through said nozzle receiving end; and a piston system operatively associated with said receptacle adjacent said opening at said other end and positioned along a longitudinal axis of the drill head; the piston system including two or more pistons that are activated in use to drive the substances within the canister when located within the receptacle, delivering the substances by way of a nozzle mounted to the nozzle receiving end into the self-drilling rock bolt assembly.

Preferably, the canister includes an injection nozzle cap extending therefrom along the axis, the injection nozzle adapted to engage with a self-drilling rock bolt in use.

Preferably, once the pistons are driven a desired distance along the axis into the canister, the pistons are retracted away from the nozzle to a start position.

Preferably, the pistons are driven mechanically or electrically by a drive method supplied adjacent the drill-head.

Preferably, the drive method includes a water or oil pressure supplied adjacent the drill head.

Preferably, the chemicals in the canister are separated by solid tubes and/or membranes until the piston system is activated to drive the substances into the self-drilling rock bolt.

Preferably, the pistons are independently and/or simultaneously operable so that a flow of each substance is independently controllable.

Preferably, the canister includes compartments housing said different chemicals, a ratio and volume of substances dispensed is controlled by a geometry of said compartments and by actions of the corresponding pistons.

Preferably, the system nozzle delivers both drilling flushing water as well as dispensing the substances.

Preferably, the canister insertable and/or removable from said receptacle by rotation and/or sliding of an end portion of the receptacle where the piston system meets the receptacle remote to said system nozzle.

Preferably, the canister is insertable and/or removable from said receptacle by lifting and/or rotating and/or sliding of a lid covering the receptacle adjacent said system nozzle, and subsequent movement of the canister relative to the receptacle out of a top opening previously covered by the lid.

Preferably, between the nozzle cap and the main body are bristles or radial fins that function to join the nozzle cap to the main body, and also provide a water passage between the nozzle cap and the main body of the canister.

Preferably, each canister includes longitudinal fins on an outside surface that function to centralize the main body of the canister within the receptacle.

Preferably, the longitudinal fins are adapted to act as spacers between the canister and the receptacle to allow balanced and equalized water flow around the canister within the receptacle, when drilling a hole.

Preferably, the injection system further includes a valve configurable between a drilling configuration and an injection configuration, wherein, in the drilling configuration, the valve provides a drilling fluid flow through a passage between the canister and the receptacle to assist with drilling of the self-drilling rock bolt; and wherein, in the injection configuration, the valve provides an injection fluid flow to provide a fluid pressure for driving the piston system for delivering the substances for installing the self-drilling rock bolt.

Preferably, the drilling fluid flow is a low pressure fluid flow and the injection fluid flow is a high pressure fluid flow.

In a second aspect, the present invention provides a cylindrical canister for an injection system for a self-drilling rock bolt assembly, the canister including:

an outer housing surrounding a plurality of compartments therein, an injection nozzle at one end and a base at the other end;

a receptacle being accessed by rotating and/or sliding the piston system immediately below, to load or unload said canister from said injection system.

Preferably, two or more pistons are driven into the base of the canister to force multiple substances located within said compartments out said nozzle in a volume and ratio-controlled manner.

Preferably, the canister includes two concentric solid cylinders, having an impervious membrane and a temporary membrane to separate and contain the different chemicals.

Preferably, an inner cylinder of the two concentric solid cylinders having a smaller radius contains a catalyst while an outer larger cylinder of the two concentric solid cylinders contains at least two mastics, separated by an impervious membrane.

Preferably, a piston pushes a circular plug located at the base of the inner cylinder.

Preferably, a second piston is donut shaped and pushes onto a donut shaped plug that is concentric to the inner cylinder.

Preferably, the pistons are adapted to move at the same rate and as a result deliver a ratio-controlled mix and volume of the substances through the nozzle.

Preferably, the temporary membranes are adapted to fail once pressure is applied by the pistons, and wherein the impervious membrane is adapted to move along the canister until the solid end adjacent the nozzle cap is reached, where the substance contained by the impervious membrane is released into the nozzle.

Preferably, the canister includes two or more concentric tubes to separate the different chemicals, the concentric tubes being adapted to collapse into a nesting arrangement under pressure when the piston system is driven.

BRIEF DESCRIPTION OF THE DRAWING

Preferred embodiments of the present invention will now be described by way of example, with reference to the accompanying drawings, wherein.

The present invention will become more fully understood from the following detailed description of preferred but nonlimiting embodiments thereof, described in connection with the accompanying drawings, wherein.

DETAILED DESCRIPTION

Figure 1:
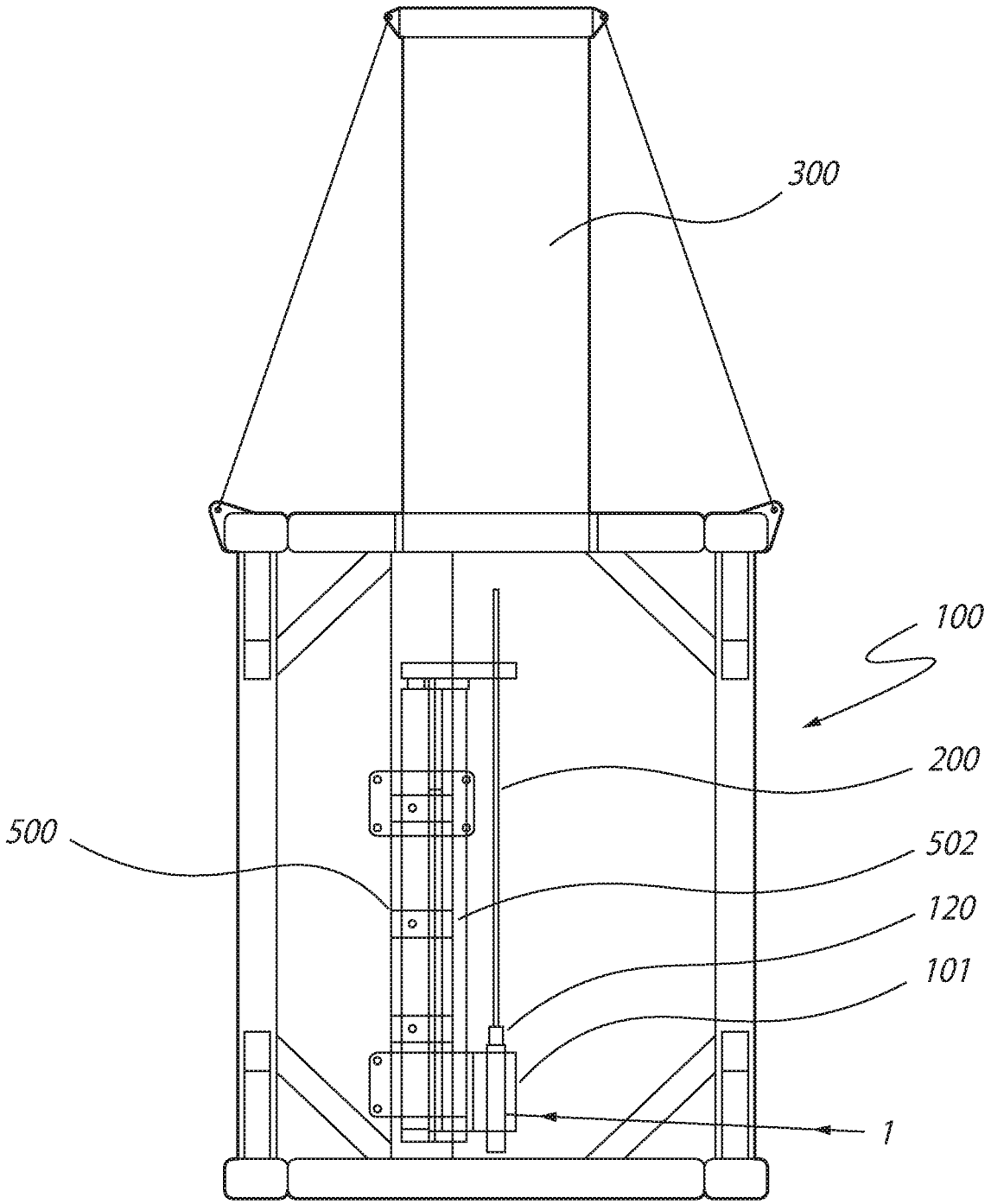
FIG. 1 shows a self-drilling rock bolt assembly having a drill head injection system of an embodiment of the present invention.

In the Figures there is disclosed an injection system for a self-drilling rock bolt assembly. The assembly 100 includes a drill head injection system 1, a drill head mechanism 101, a nut coupling portion 120, a rock bolt 200, a drilling assembly 500 and mast 502. In the drawing, item 300 shows a test substance which in use would be strata.

Figure 2:
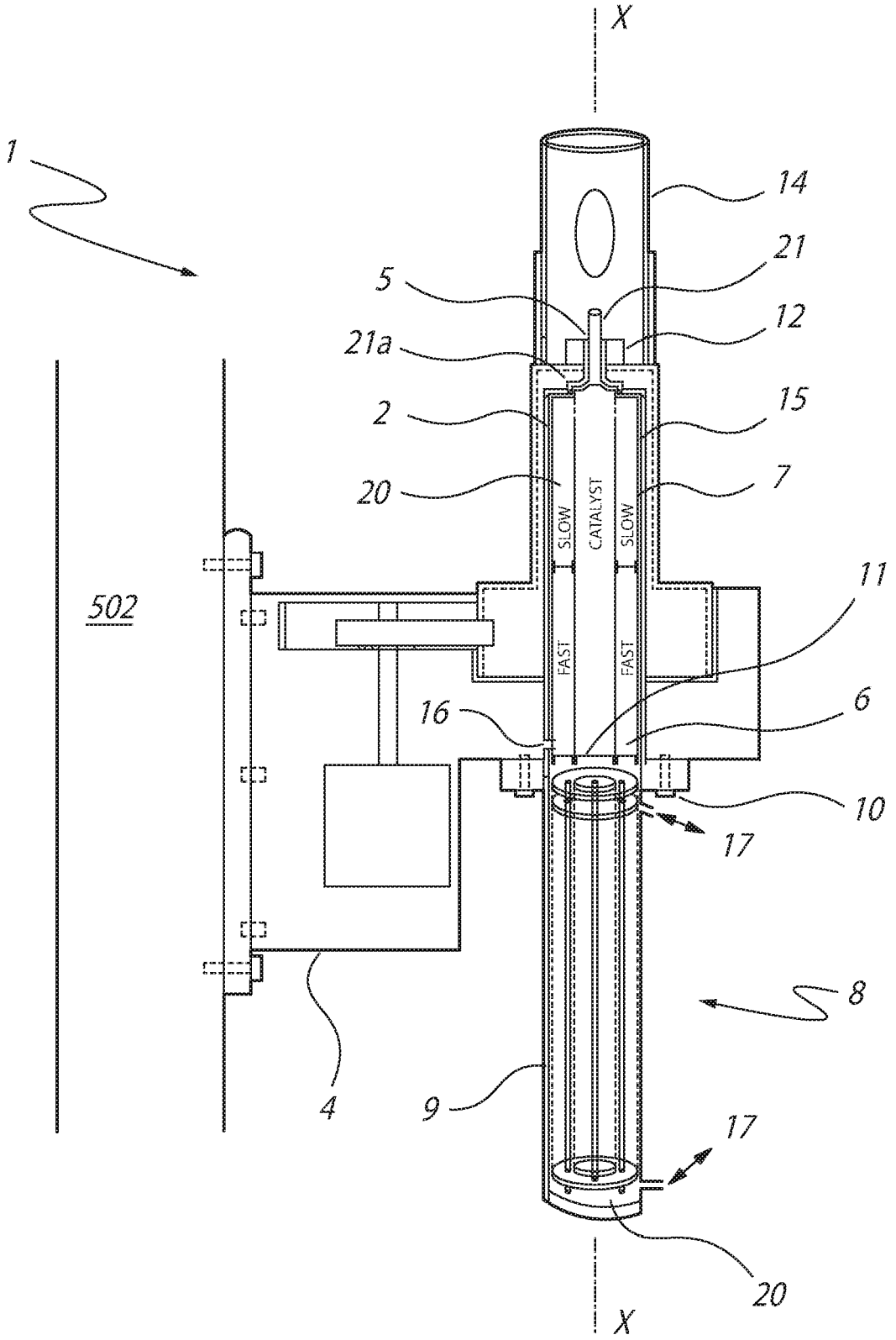
FIG. 2 shows a cross sectional view of an embodiment of the injection system for a self-drilling rock bolt assembly of the present invention.

The system 1, as best seen in FIG. 2, includes a receptacle 2 to be located in use within a drill head 4 of a self-drilling rock bolt assembly 1. The receptacle 2 having a nozzle receiving end 5 at one end and an opening 6 at the other. The receptacle 2 is shown in more detail in FIG. 5. A canister 7 (best seen in FIG. 3) is located within the receptacle 2. The canister 7 is adapted to supply three or more chemicals through the nozzle 21. The different chemicals placed in separate compartments 20. A plunger system 8 is locatable immediately below the receptacle 2 through the other end opening 6 and positioned along a longitudinal axis XX of the drill head 101. Throughout this specification, the term "plunger" and "piston" are interchangeable and generally refer to a component that is driven to impart a pressure. The plunger system 8 including two or more plungers 9 that are activated in use to drive several plugs 10 at the base 11 of the canister 7 when located within the receptacle 2, delivering the contents of the canister 7 via the system nozzle 21 and subsequently into the self-drilling rock bolt 200. It should be understood that in use the shaded areas on FIG. 2, rotate when drilling. The plunger frame 9 does not rotate about the XX axis in use. The plunger body rolls away from the bottom 20 to allow removal of a spent canister 7 and inserting of a new canister 7. The nozzle 21 may be surrounded by a drive keyway 12 and a nut tensioner 14. A water jacket 15 sits between the receptacle 2 and canister 7. This is so the drilling water is directed to the nozzle for discharge directly into the bolt. There are also provided drilling water supply ports 16. Also, water and/or oil ports are supplied to drive the plunger system up or down.

Figure 3:
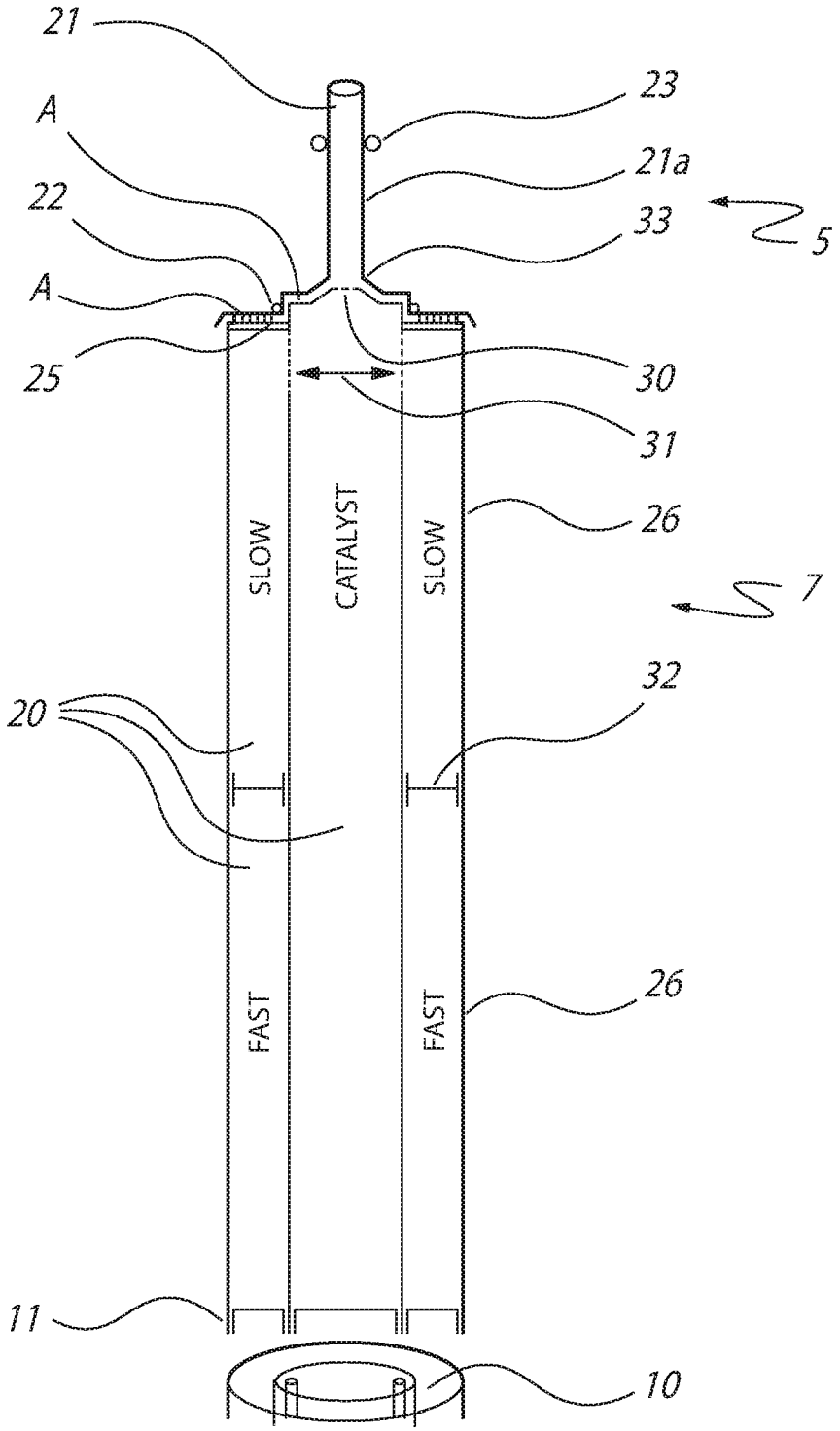
FIG. 3 shows a further cross-sectional view of the canister, an element of the injection system for a self-drilling rock bolt assembly of the present invention.

The canister 7 as shown in FIG. 3, the nozzle end fits into the bolt above the water seals within the bolt, 23. There is a clearance of the cap 21*a* and canister 7 of about 3 mm in some places and 5 mm in other places as shown at A in FIG. 3. Thin crushable bristles or radials 25 allow water between the cap 21 and canister 7. The canister 7 can include fins 26 to centralize the canister and not impede water flow. The canister 7 can include a number of pierceable membranes 30, 31 which in use will not allow the different chemicals to mix. This impervious membrane 32 slides along the canister 7 towards the nozzle 21. Perforations sealed by membranes can take the form of holes 31 in the catalyst cylinder covered with breakable membranes. The nozzle can also include an extension 33 to pierce temporary membranes.

Figure 4A:
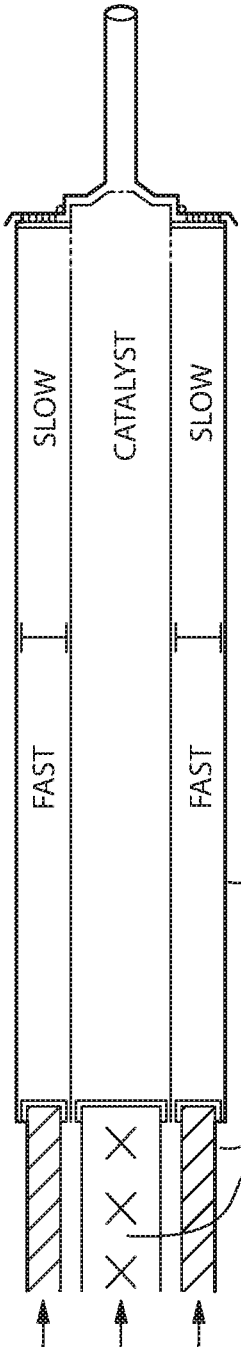
FIG. 4*a, b* shows the system of FIG. 3 in different stages of commercial injection.
Figure 4B:
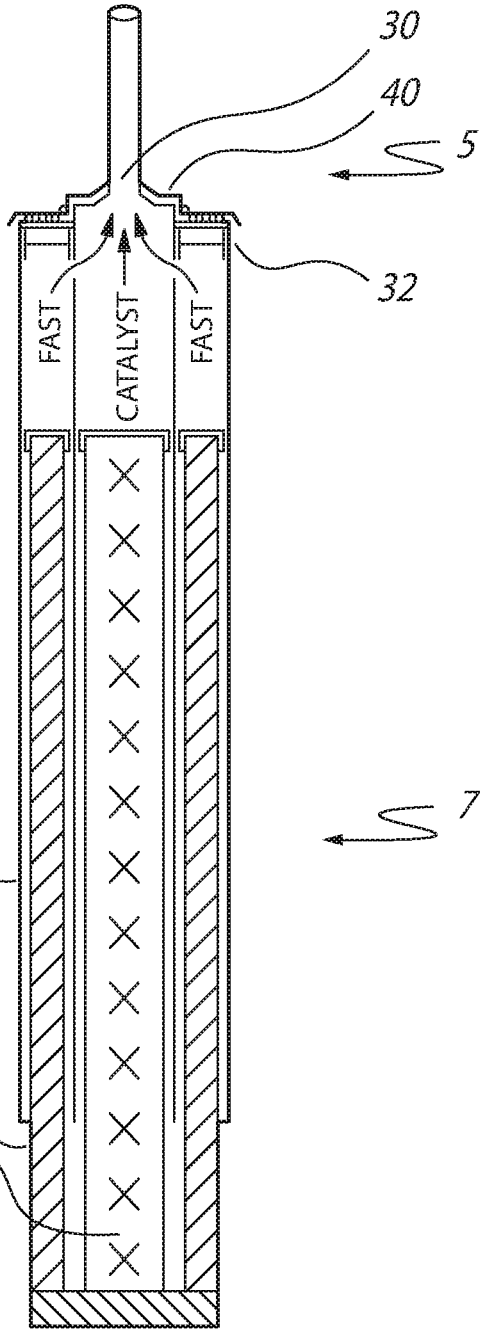
Figure 6:
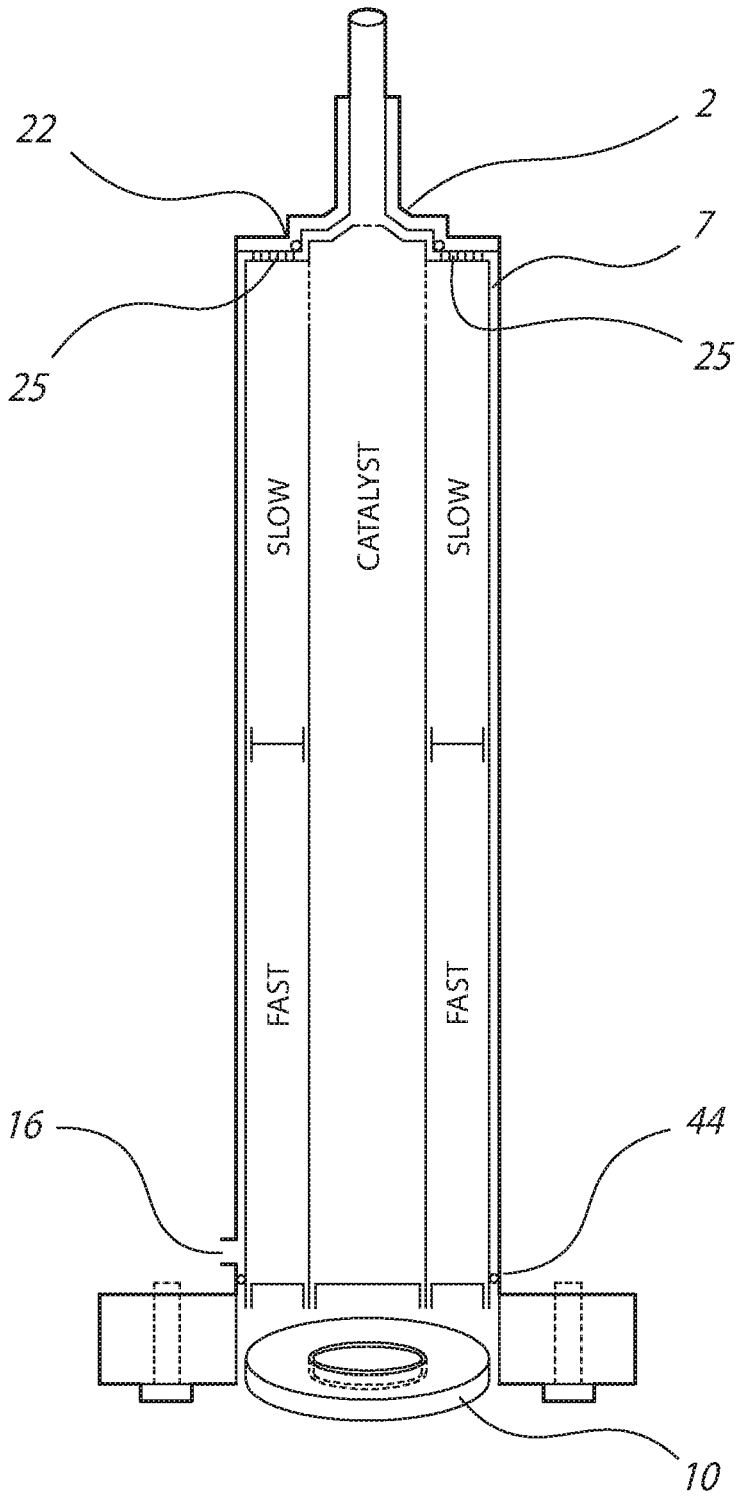
FIG. 6 shows the chemical canister installed within the receptacle of FIG. 2.

In FIGS. 4*a, b* operation of the canister 7 is shown. FIG. 6 shows the canister 7 placed in the receptacle 2 and water is passing between the cap 21*a* and the canister main body. FIG. 4*b* shows after the plunger 9 pressure is applied to the base 11 (See FIG. 3). It will be noted that membrane 30 has been broken and water passages 40 closed. The donut membrane 32 which was separating slow and fast mastic is now hard against the canister end allowing fast mastic to discharge through the perforations within the catalyst cylinder end (that is, temporary membrane is now destroyed).

Figure 5:
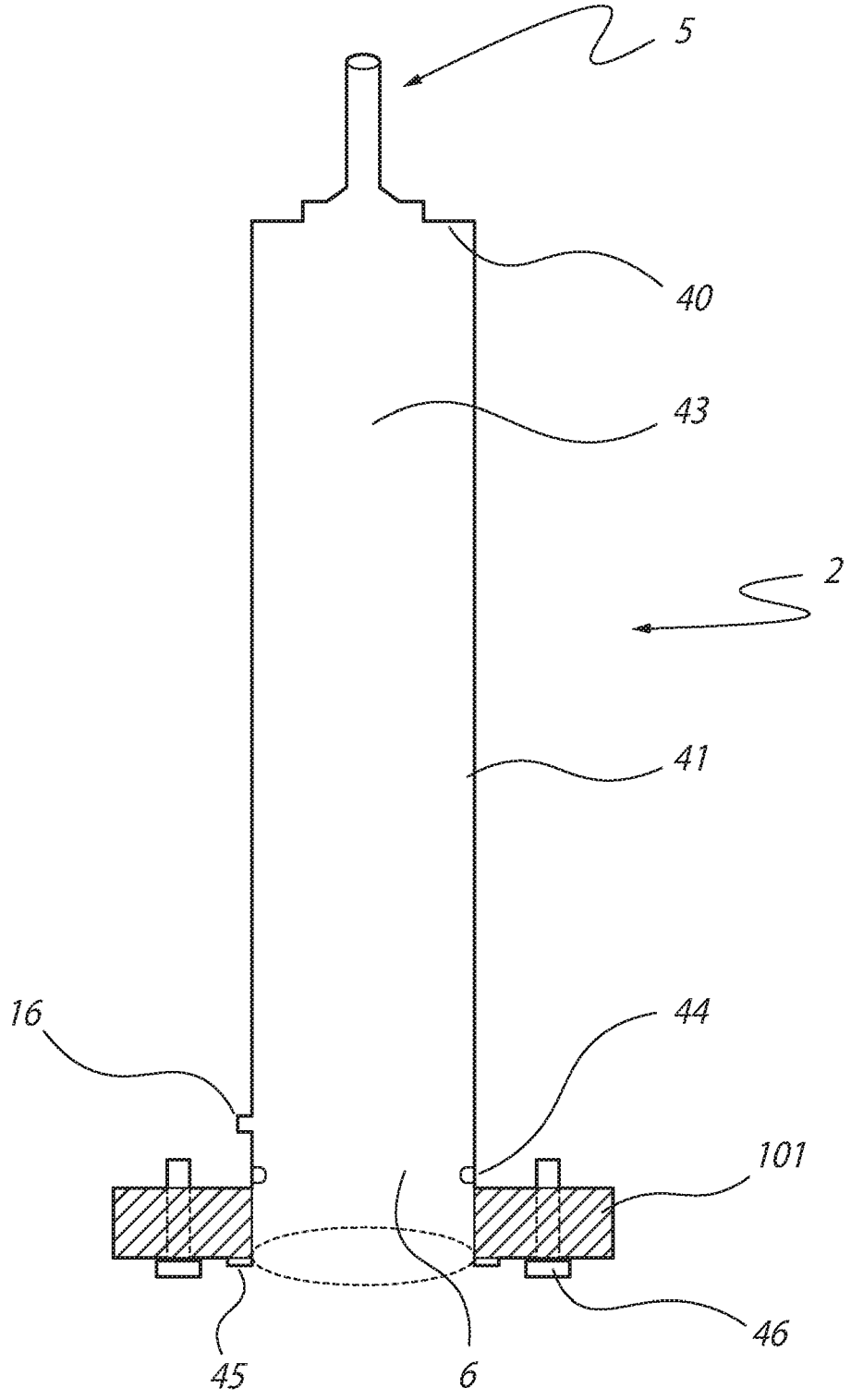
FIG. 5 shows a cross sectional view of the receptacle of FIG. 2.

Referring specifically to FIG. 5, there is shown one design of a receptacle 2. The receptacle 2 having a nozzle receiving end 5 having a stepped portion 40 (to accommodate canister nozzle and cap) leading to an elongate body 41 extending to the opening 6. The canister 7 fits within the receptacle hollow 43. The receptacle 2 also provides an outer water jacket casing. The space between the outside of the canister and the inside of the receptacle, is where the drilling water passes through the system. There is included a water inlet 16 and O-ring seals 44 to seal the water jacket. These could alternatively be on the canister. The receptacle 2 includes flanges 45 which are fastened by bolts 46 to the drill head.

In FIG. 6, the receptacle 2 is shown with the canister 7 within. The gap between the canister main body and the nozzle cap varies from 3 mm through to 5 mm, where the bristles or radial fins are located. When drilling is complete and the chemicals are to be injected, the canister is pushed hard by the plungers and the 3 mm gap is closed to provide a seal to prevent the chemical escaping anywhere ensuring it travels through the nozzle.

That is, there is an injection system within the drill-head and a chemical canister 7 to operate with the injection system. Prior concepts do not have an injection system within the drill-head. Also, prior canister products do not have multiple chemicals within a canister. The system of the present invention allows chemically anchored (fast set and slow set) pre-tensioned bolts to be installed and allows for automation of the process.

More specifically referring to the figures the injection system dispenses the contents of a canister to provide the best way to inject multiple fluid resins in controlled ratios and volumes into a self-drilling bolt during the installation process.

The problems solved relate to pumping and displacing chemicals a distance through hosing and valving causing blockages and high pressures. Also, the nozzle 21 inserted into the bolt is no longer able to get blocked after repeated injections as it is replaced together with each new canister 7, rather than being a permanent injection needle as used in previous approaches. The concept described and shown in FIG. 10 however, would require a cleaning fluid delivered at the end of each injection to avoid chemical build up and blockage.

As shown in FIG. 3 the canister, made of metal or plastic, includes an injection nozzle at one end, fits into a receptacle within the drill-head. When the canister is installed in the receptacle, it is designed such that the injection nozzle protrudes from the chuck surface and allows engagement with the receiving end of a self-drilling rock bolt when it is placed into the chuck. An O-ring within the self-drilling bolt seals the end of the nozzle within the bolt inner tube.

The receptacle is situated immediately below the top of the drill chuck surface. Immediately below this receptacle is a piston/plunger system that when activated, drives into the canister (injecting the contents into the self-drilling bolt via the nozzle) and also retracts the piston/plungers when the canister is emptied.

Once a drill-hole is completed by the self-drilling rock bolt, the chemical canister contents are injected into the self-drilling rock bolt using the pistons/plungers. The canister/plunger combination is designed to provide a metered ratio and volume of chemical combinations from within the canister. The plungers are driven by water pressure or hydraulic oil pressure, or some other mechanical/electrical method, preferably located adjacent the drill head. The plungers are returned to a start position using either water or oil pressure or could return via a spring or gas in another configuration. In a preferred embodiment, the pistons or plungers are not returned, but are discarded with the canister in the fully extended position.

The receptacle is opened to remove a spent canister and allow a fresh canister to be placed inside, then closed prior to use in the system.

The advantage of the system, at least in a preferred form, is because the system is installed on the drill-head it allows the canister to house the injection needle which can be renewed with every self-drilling bolt installation. The injection needle cleanliness is a major area of concern that can now be resolved when injecting catalyst and mastic resins.

The injection system allows the self-drilling bolt to stay in the strata whilst the chemicals for anchoring it are installed. This saves time and removes a step in the process compared to standard practice of inserting a chemical cartridge manually into the drill-hole after retracting the drill-head from the strata surface being drilled.

The injection system within the drill-head also allows for automation of the self-drilling bolt installation, as several steps are no longer required, and the reliability and speed of chemical injection are high. This is advantageous for underground coal and metal mining strata support. Also, tunnelling and civil projects requiring strata support.

As shown in FIG. 2 the canister receptacle and injection system are positioned centrally along a longitudinal axis XX around the centre of the drill head and are in direct contact with each other. The consumable product is the canister containing various chemicals for anchoring a rock bolt.

The energy to drive and retract the piston/plungers is provided by water or oil pressure supplied at the drill-head. Gas or springs may also be used in another form to drive and retract the piston/plunger system.

The contents of the canister 7 are injected by the plungers 9 into the inner passageway of a self-drilling rock bolt. The rock bolt is engaged with the injection needle and is sealed by an O-ring positioned within the engaged section of bolt.

The injection system within the drill-head also allows for simpler automation of the self-drilling bolt installation, as several steps are no longer required, and the reliability and speed of chemical injection are high.

The invention removes the problem of requiring pumps, valving, electronic control systems and hosing/piping to deliver the chemicals from a remote location to the drill-head for injection into the self-drilling bolt.

In specific reference to the canister 7, it is preferably made of metal or plastic with an injection nozzle and multiple fluid chemical types within. Injecting fluid chemicals into a self-drilling bolt in a repeatable, reliable fashion. It provides significant size reduction of components/equipment to get the various chemical components supplied to the injection nozzle. It allows an injection system to be placed within the drill-head, removing need for remote pumping and injection, valving, hosing and complicated electronic software control systems.

As the chemicals must not interact until dispensed there are provided membranes 30 and 31 as discussed above. Also, the resins within the canister 7 flow and are able to fill the inner tube within a hollow bolt, as well as the outer bolt annulus. The ratio of catalyst to mastic for each of the slow and fast set resins are designed into the canister 7 geometry and dimensions. The injection plungers 9 travel at exactly the same rate so that the dispensed canister chemicals are administered in exact ratio and volume of each chemical as required.

The canister 7 has a unique injection nozzle 21 on one end. The shape, diameter and length are critical to forming an integral part of the injection system 1. All chemicals are injected through the nozzle 21 by the driving plungers 9. There are membranes 30, 31 and 32 within the canister 7 to separate and contain chemical flow until the injection process is applied to the canister 7.

Advantageously there are two or more fluid chemicals separated within the same canister 7 as shown. The chemicals are kept separate by membranes 30, 31, 32 until the injection process is applied to the canister 7. The design of the injection system 1 allows separate plungers 9 to control the flow of at least three different resins and catalyst such that volumes of each chemical and ratios of chemicals combined on discharged through the nozzle are controlled. The ratio and volume of chemicals dispensed is controlled by the geometry of the compartments within the canister and by more than one plunger. The nozzle 21 is used for delivering both the drilling flushing water as well as the chemical discharged.

In use two or more different chemicals are used as you cannot achieve fast set and slow set chemical combinations with catalyst to be injected into the self-drilling bolt otherwise. To achieve a chemically anchored pre-tensioned rock bolt, must have fast set and slow set chemicals installed. One plunger alone will not allow this system to work. Volume and ratio control of discharge from the canister would not otherwise occur. At least 2 plungers are required so that the various ratios of mastic to catalyst can be administered from the one canister. The two chemical types (mastics and catalyst) must be kept completely separated, hence the two plungers 9 are required to drive the chemical from two primary segregated compartments/cylinders within the canister 7.

In one form, the canister 7 is two concentric cylinders, with various membranes 30 within each, to separate and contain the different chemicals. The inner smaller radius cylinder may contain the catalyst while the outer larger cylinder, (effectively donut shaped) may contain the two mastics, separated by an impervious membrane. One piston 9 pushes a circular plug located at the base of the inner cylinder. The other plunger 9 is donut shaped and pushes onto the donut shaped plug that is concentric to the inner cylinder. The membranes 30, 31 fail once pressure is applied by the plungers 9. The plungers 9 move at exactly the same rate and as a result deliver a ratio-controlled mix and volume of chemicals through the nozzle 21. The two concentric cylinders may alternatively be embodied as concentric tubes to separate the different chemicals, the concentric tubes being adapted to collapse into a nesting arrangement under pressure when the piston system is driven.

The canister's function is to store the various chemicals in a segregated manner and supply a new delivery nozzle 21 to the injection system 1 each time it is used. It also stores the chemical in a geometry that ensures guaranteed correct ratio and volume is delivered when the plungers 9 drive through the canister compartments at exactly the same rate and time.

The advantage of this canister system for storing flowable chemicals is that a large supply tank is no longer required, and a remote pump system is not required either. Chemical temperature for controlled flow is critical and this system allows chemicals to be easily kept within the desired temperature range.

It also allows injection of liquid chemical to take place extremely close to the delivery needle, doing away with porting, valves, pumps and hoses. It also reduces significantly the control systems (electronic and hydraulic) required for injection activated remote from the drill-head.

Another significant advantage is the supply of a disposable delivery needle/nozzle 21 with each and every chemical injection process. Injection needle cleaning has been a very real issue of concern when using catalyst and mastics. Any contact between the two causes build-up of hardened material in the needle/nozzle.

No other system has more than two liquid chemicals in the one cartridge/container, providing many application benefits. An example is the requirement to provide a pre-tensioned chemically anchored rock bolt. To pre-tension a rock bolt requires a fast set/catalyst component and also a slow-set/catalyst component. Typically, this requires at least three different chemical types. In other applications, only one type of mastic component may be required, meaning that only two types of chemical are required.

In another form, the canister may be of various diameters. In the preferred form, the canister may be a smaller diameter from the nozzle end for a given length and a much larger diameter for the remainder. This allows for the plunger system to be of the larger diameter and hence a shorter length to discharge the same amount of chemical. A sacrificial fluid/medium (e.g., water or other inert fluid) may be required between the plunger ends and the final chemical impervious membranes (inner and outer) in order to extend the reach of the plunger driving force. If the sacrificial fluid is water, it may already be contained within the canister and contain a small amount of additive for lubrication and resistance to bacterial growth. The sacrificial water may also be added just prior to the installation process.

Figure 7:
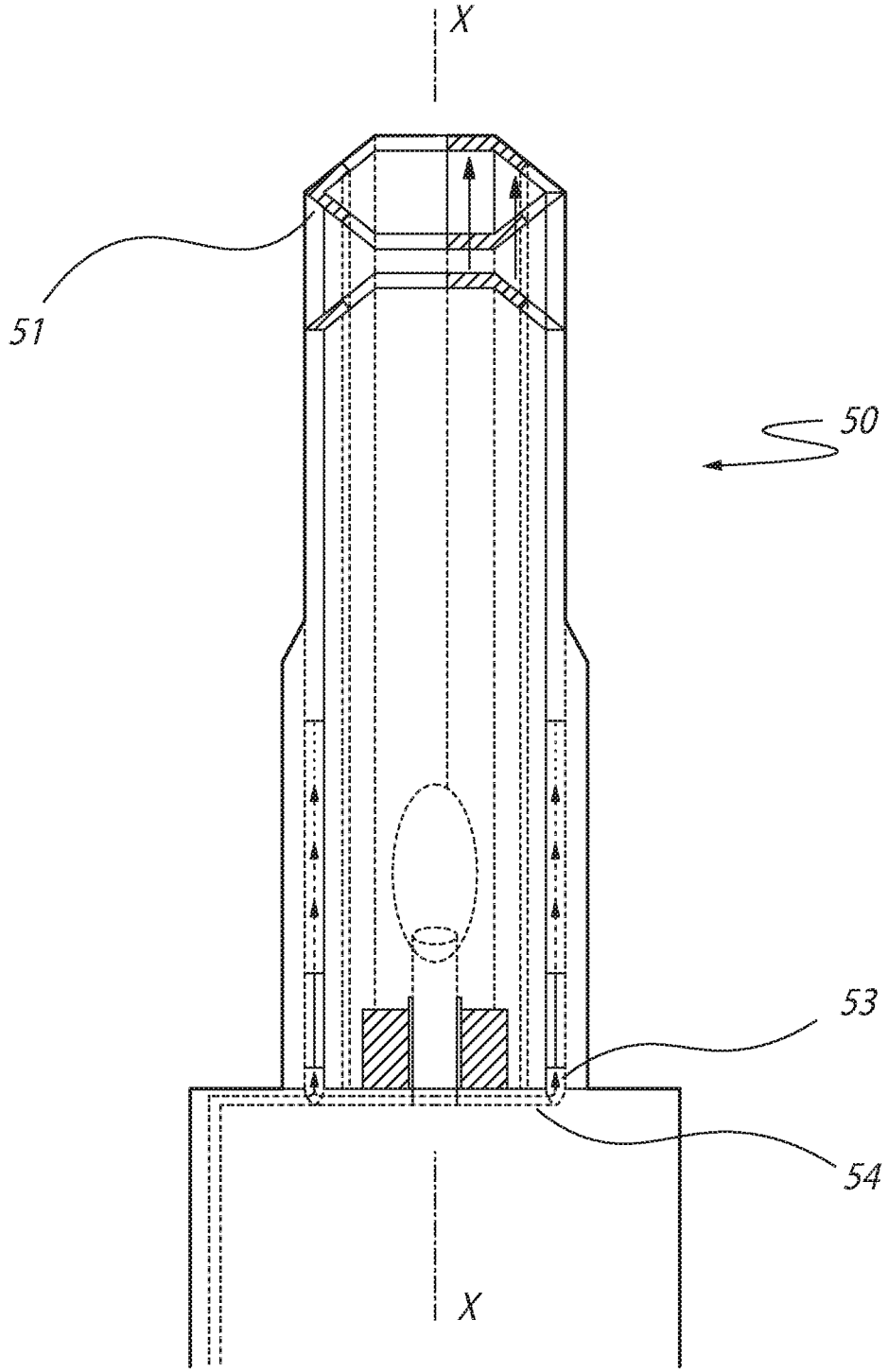
FIG. 7 shows an extendable nut tensioner for use with the system of FIG. 2.
Figure 8A:
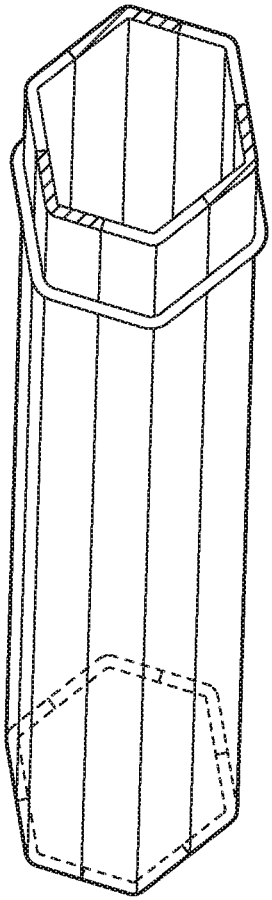
FIGS. 8*a, b* show a further extendable nut tensioner for use with the system of FIG. 2.
Figure 8B:
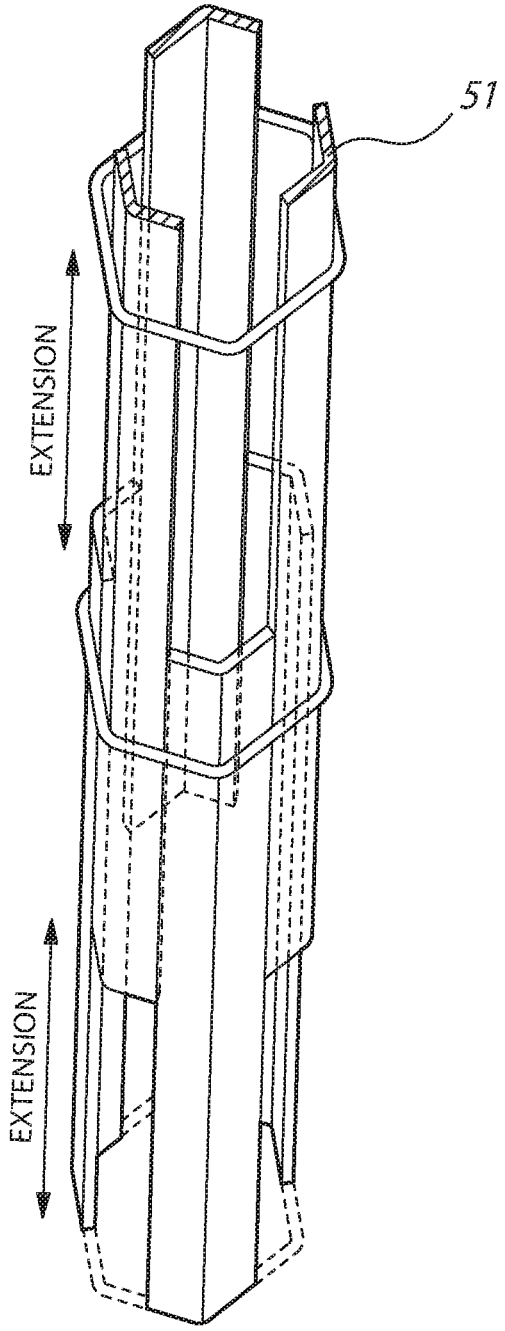

There is further disclosed in FIGS. 7, 8*a, b* an extendable nut tensioner 50. The current nut tensioners on drill heads have the disadvantage that they cannot be extended when greater reach is required when tightening a bolt/nut system (such as the above) where a cavity exists in the strata being drilled. The embodiment shown herein allows the tensioner 50 to extend along the axis XX from the chuck towards the strata (when oil pressure is applied to the ports 54 and piston chamber 53) to enable greater reach when tensioning the nut against the collar of the hole. It can be hydraulically driven when activated, extending every second angled section 51 of the tensioner 50 (when pressure is applied to the piston chamber 53), allowing the hexagonal nut to be torqued over a greater distance from the chuck. In another form, it can be extended as a total unit, with the complete hexagonal profile extended towards the strata, allowing the nut to be torqued using all six sides of the profile. This form requires hydraulic control at a specific time in the process, to ensure the hexagonal nut is at all time engaged with the hexagonal profile of the tensioner.

Figure 9:
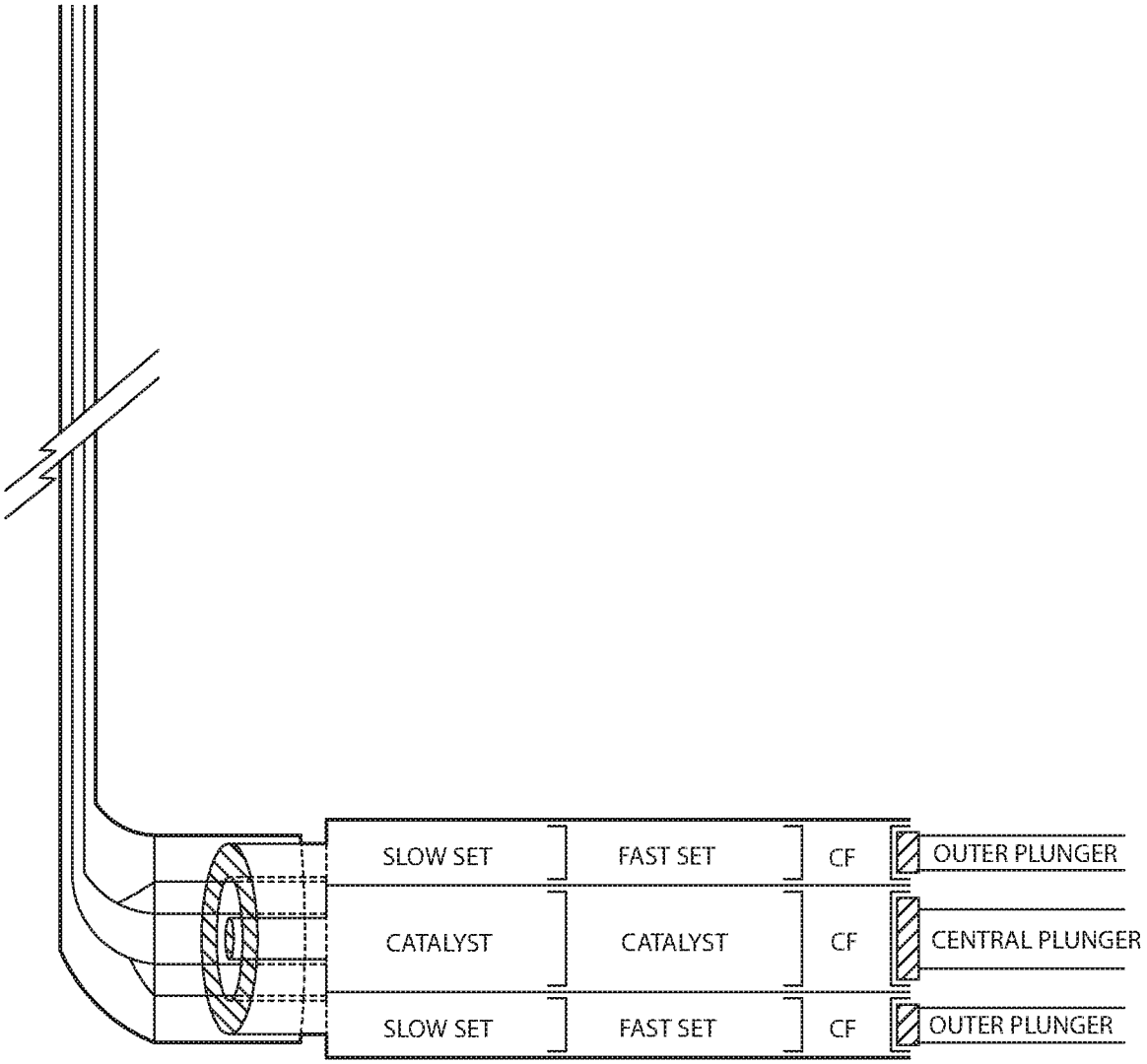
FIG. 9 shows an alternate canister and injection arrangement.

In another form and as shown FIG. 9, the receptacle/canister/injection plungers may be positioned outside of the XX axis. They may be horizontal or some other relationship to the XX axis. The chemicals from the canister may be directed to an inner and outer needle as required, as per the applicant's previously mentioned patent. The canister would also require a fourth chemical, a cleaning fluid, to be injected at the end of each injection, to clean both inner and outer needles.

Figure 10:
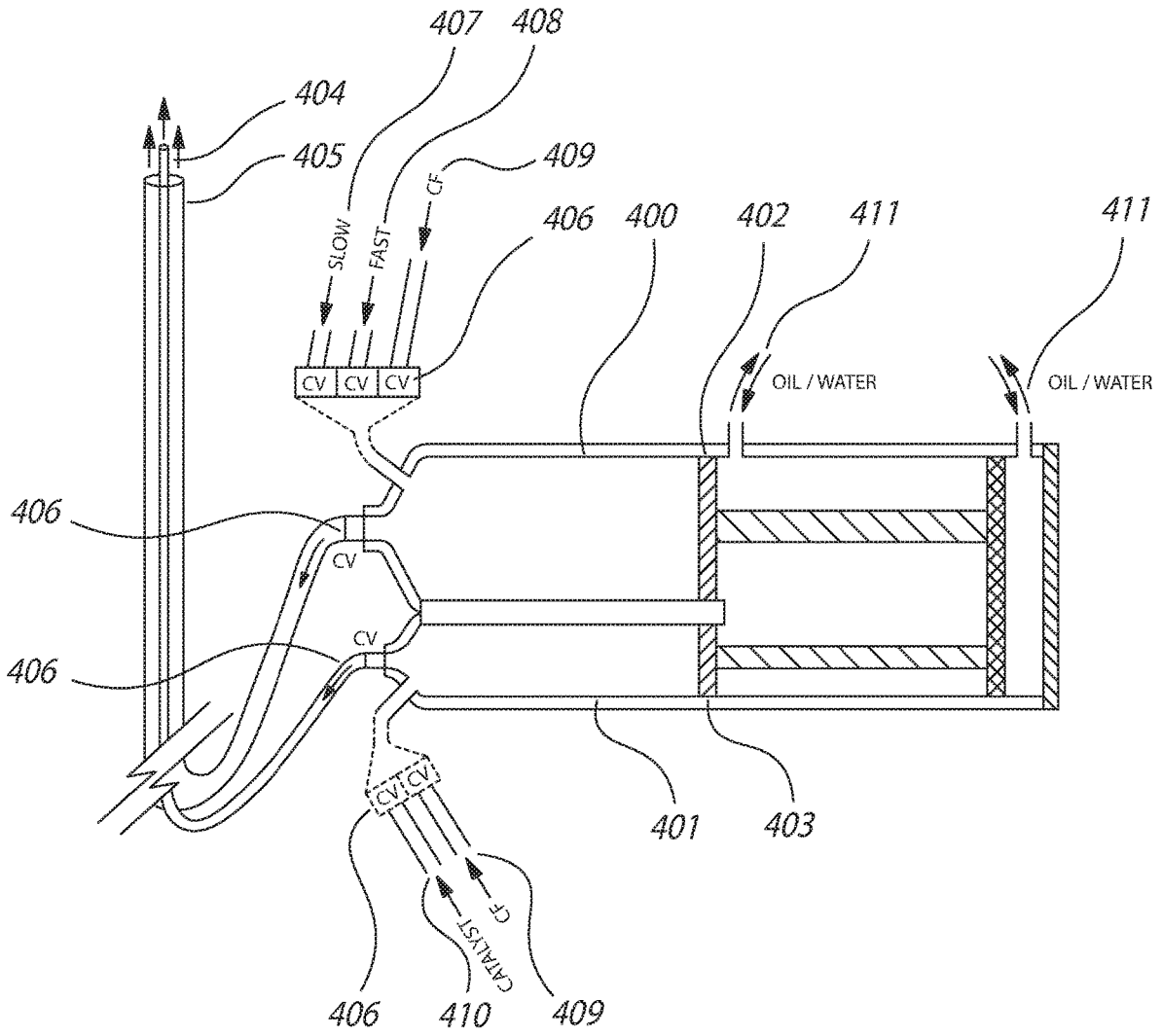
FIG. 10 shows an alternate canister in the form of a rechargeable fixed ratio cylinder set and injection system.

In another form and as shown in FIG. 10, the injection system is installed on the drill-head, but the receptacle and consumable canister arrangement is replaced with two cylinders that are recharged with chemicals pumped to the drill-head and injected via simultaneous pistons into the self-drill bolt via the injection needle.

The Cylinders 400 and 401 are firstly charged with slow mastic 407 and catalyst 410 respectively. The pistons, 402 and 403, are driven simultaneously to discharge the contents of cylinders 400 and 401 directly into the needles, 404 and 405, and hence into the self-drill bolt. Control Valves (CV-406) are required at critical locations where chemical is forced into or out of the cylinders 400, 401. The control valves 406 ensure that the re-charging and discharging of chemicals to and from the cylinders 400 and 401, are direction and volume controlled as required. Next, the same cylinders 400, 401 are re-charged but this time with cylinder 400 filled with fast mastic 408 and cylinder 401 again filled with catalyst 410. Again, the cylinders 400, 401 are discharged by the injection pistons, 402 and 403, into the needles, 404 and 405, and hence into the self-drill bolt. Finally, the 400 and 401 cylinders are both re-charged with cleaning fluid 409 and discharged into the needles 404, 405 and hence self-drill bolt via the pistons, 402 and 403. Oil and/or water can enter and/or exit at 411 as required.

The length and diameter of cylinders 400 and 401 are such that the required ratio and volume of chemical mastic to catalyst is pre-determined. This is critical to providing a chemically anchored pre-tensioned bolt.

At all times the mastic and catalyst are not combined until they are inside of the self-drill bolt after exiting the injection needles, 404 and 405. (The inner and out needles are sealed within the bolt by an O-ring installed within the rock bolt).

The two pistons (402 and 403) are driven by water or oil pressure, or some other mechanical or electrical method, at the same time independently or may be connected at the drive end and driven simultaneously by the one pressure source. The stroke length of the pistons may be varied to accommodate specific chemical volume requirements for any length self-drill rock bolt.

Figure 11:
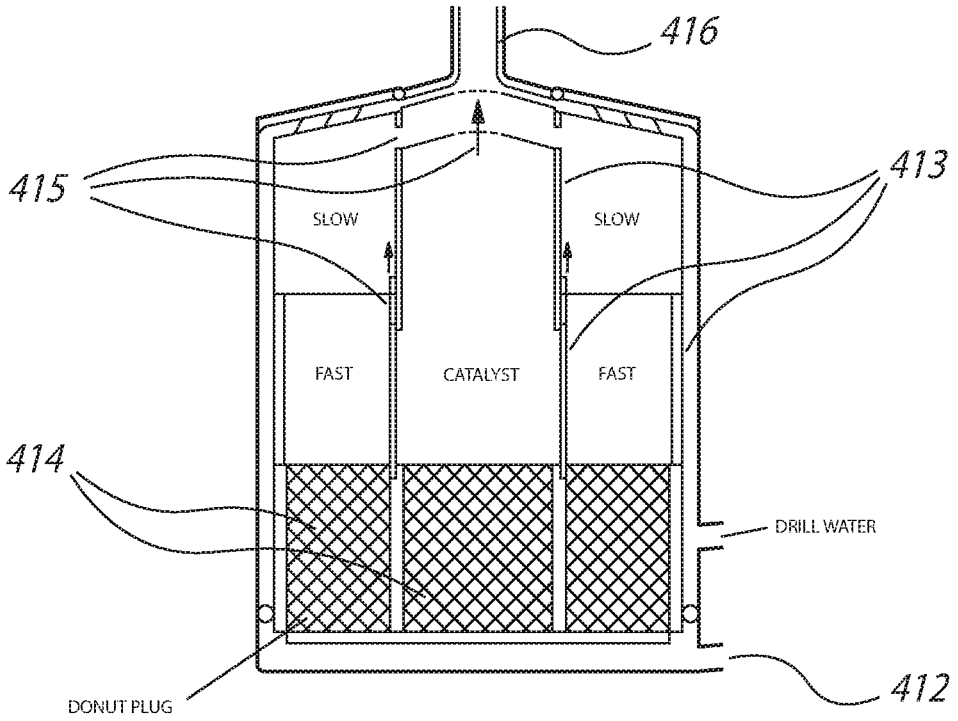
FIG. 11 shows an alternate canister arrangement.
Figure 12:
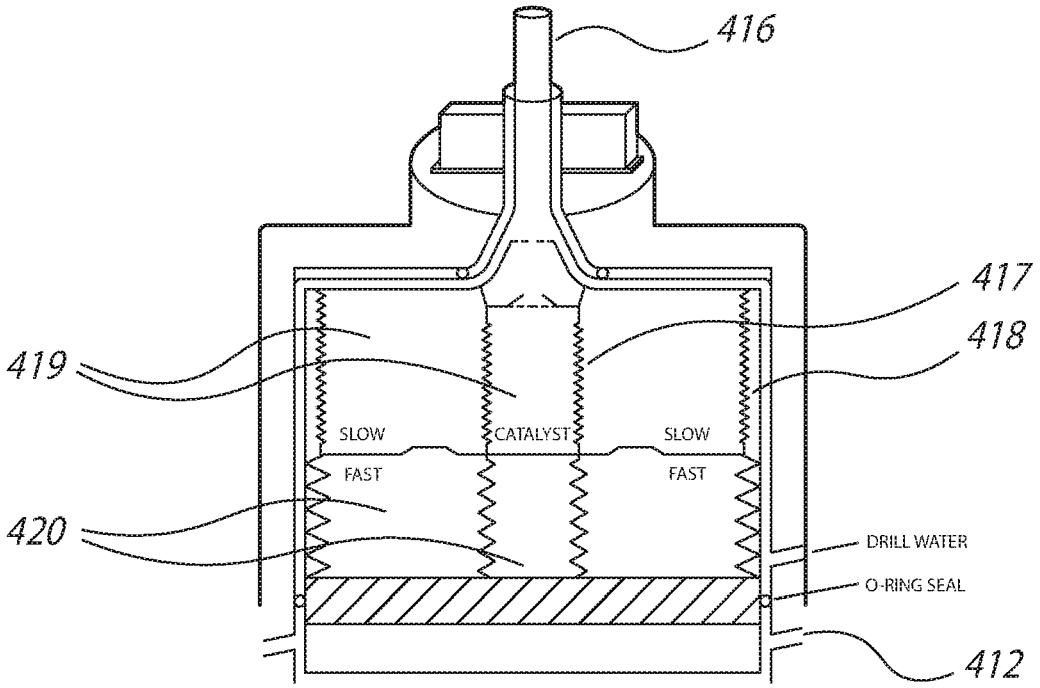
FIG. 12 shows an alternate canister arrangement.

In another form and as shown in FIGS. 11 and 12, the injection system is installed on the drill-head, but no plungers are required. A receptacle accepts a canister containing the slow and fast mastic and catalyst which is discharged into the bolt via a nozzle attached to the canister. However, the arrangement inside the canister is such that a plug/piston at the base can be driven through the canister to discharge the chemicals in a controlled ratio and volume through the nozzle and into the bolt.

The plug at the base may be pressure driven through the canister by water, oil, gas, 412, or any other method.

The preferred arrangement inside the canister shown in FIG. 11, takes the form of concentric tubes, 413 that slide within each other as each chemical combination is discharged. The concentric tubes collapse into each other as the chemicals are discharged. The elongated plugs, 414, at the base slide within the final tube set to totally eject all chemical within. Temporary and permanent membranes and passageways, 415, are required in the design that fail or are accessible sequentially as tubes slide to strategic locations or as higher pressures are reached, allowing the various chemical combinations to be discharged through the nozzle, (416). The chemicals may be free flowing within the compartments or within packaging, e.g. foil, within the various compartments.

A similar arrangement, see FIG. 12, has concertina like concentric tubes compartmentalising the various chemicals. The inner and outer tubes, 417 and 418, have varying pressures required to cause the concertizing to action. In this way, the slow chemical and matching catalyst are both within the first concertizing section, 419, discharging first, then the fast mastic and catalyst are contained within the next concertina tube section, 420, requiring higher pressures to effect the concertizing, and also due to their location within the canister, are discharged after the slow and catalyst combination are already discharged. Again, the geometry of the concentric tubes controls the ratio and volume of chemicals as they are discharged. Again, the chemicals may be free flowing within the compartments or within packaging, e.g. foil, within the various compartments.

Figure 13:
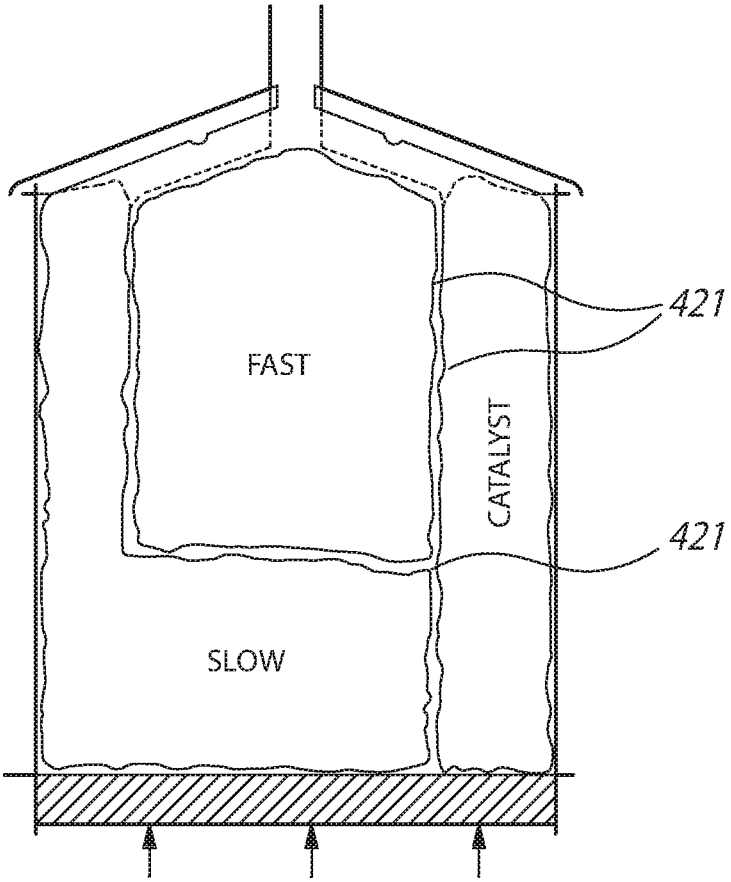
FIGS. 13 and 14 shows a further canister arrangement.
Figure 14:
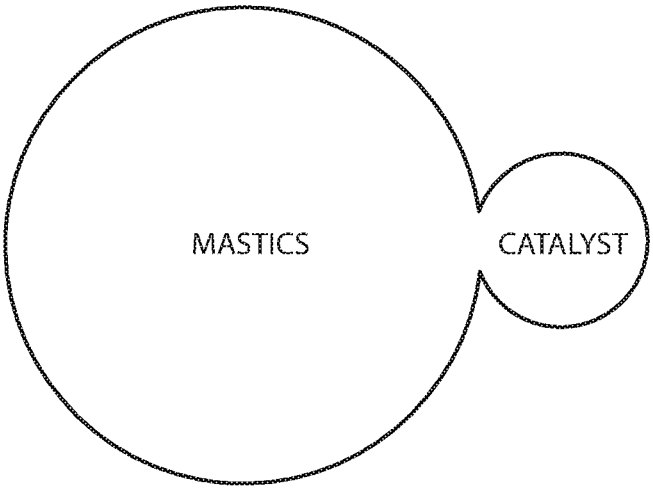

Another similar arrangement, see FIGS. 13 and 14, has only soft bags (foil or similar chemical resistant material, 421) that are arranged within the canister such that as the plug pushes through the canister and discharges the chemicals through the nozzle, the ratio and volume of each chemical type is controlled by the cross sectional areas of the bags.

The canister may be circular in cross-section, FIG. 13, or it may be an irregular shape, FIG. 14. The plug shape (plan view) in FIG. 14 is the same shape (plan view) as the canister housing the various chemicals. The plug slides through the canister discharging both catalyst and mastic at the same rate.

Figure 15:
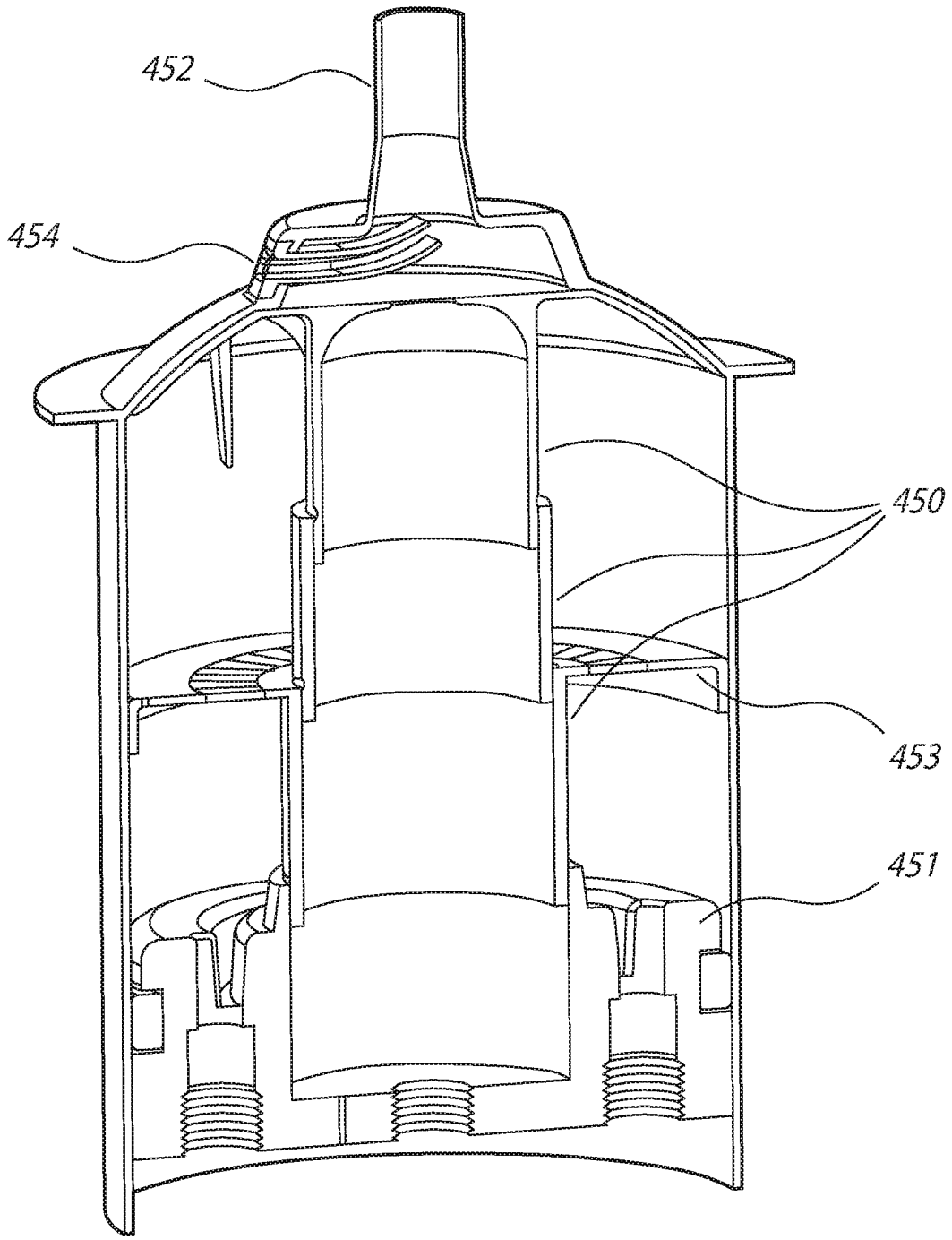
FIG. 15 shows a further alternate canister arrangement.

Another preferred arrangement is shown in FIG. 15, showing a similar structure to FIG. 11. This embodiment uses a canister 7 much like the previous canister, however the canister 7 used in this embodiment is different some respects as discussed herein. In this embodiment, the concentric tubes 450 contain the catalyst and collapse within each other as the volume of chemicals within the canister is ejected through a nozzle 452. There are four tubes shown in this version. The piston 451 at the base is exposed to a pressurised fluid flow, such as air, oil, or water, forcing the piston 451 to move towards the nozzle 452 end. As the piston 451 moves under urging of the pressurized fluid, the substances are injected through the nozzle 452 into the hollow rock bolt inner tube. Each substance is ejected in correct ratio and volume as required due to a variety of controlled factors. Firstly, the geometry of the canister 7 is controlled, such that, for example, changes in diameter of the canister 7 result in changes to the volume of relevant substance dispensed. The collapsing tubes; temporary membranes; and breakable separation plates 453 are designed to be broken at relevant times within the process to allow the contained substance to be released during the appropriate moment of the injection process. The drilling water enters the canister 7 at the inlet 454 and passes through the passage to the nozzle 452 into the self-drilling rock bolt assembly 1 for drilling purposes.

Figure 16:
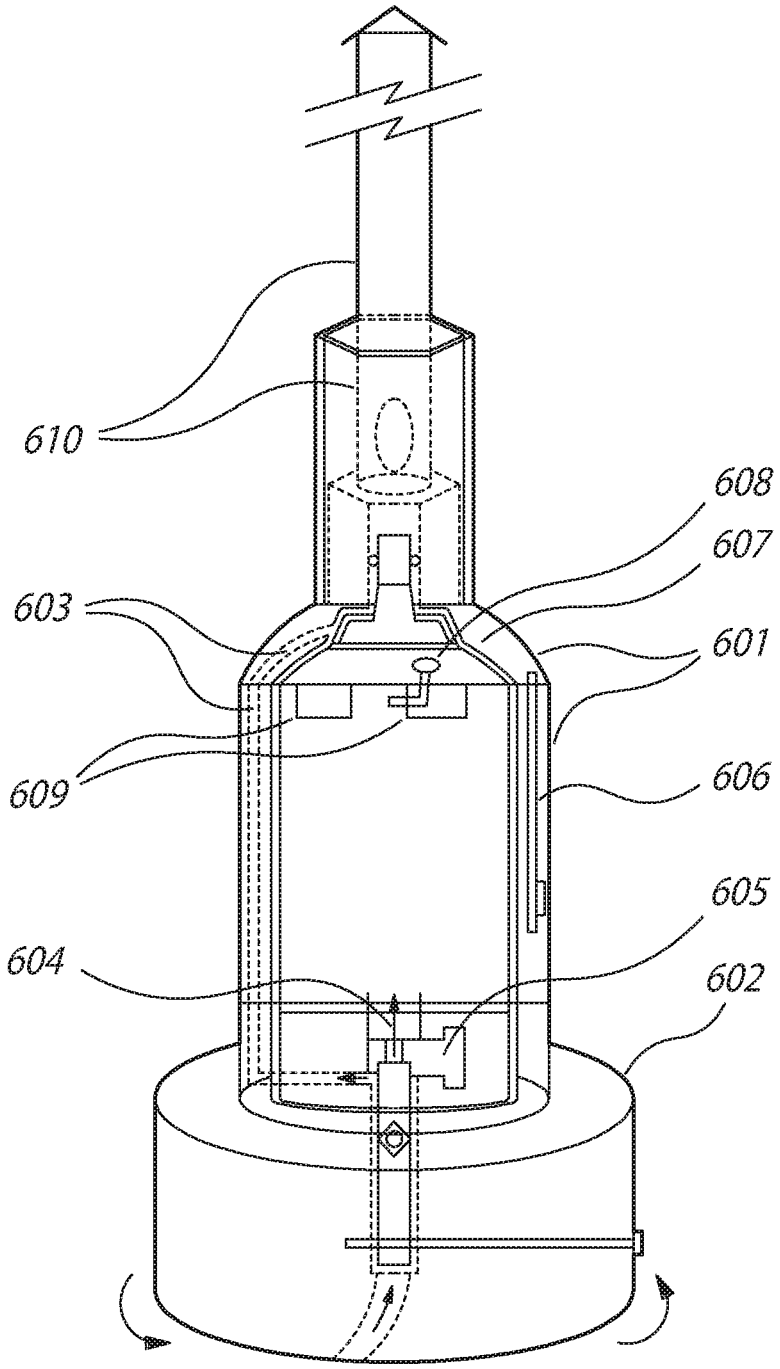
FIG. 16 shows details of a receptacle used with the further alternate canister arrangement of FIG. 15.

A preferred form of the receptacle 601 used to house the canister 7 described in FIG. 15 is detailed in FIG. 16. The receptacle 601 may take the form of an adaptor to a drill-head. The drill-head is a widely standardized driven component used in mining applications. The adaptor may be incorporated into a new purpose built drill head design. The receptacle 601 contains a cylindrical void that has the same diameter and a slightly larger volume than the canister 7. In the embodiment of FIG. 15, the receptacle 601 spins with the drill head rotating element 602 as a hole is drilled into the strata by the self-drilling rock bolt assembly 1. Preferably, at the base of the receptacle 601, two water inlets/outlets are provided. A first drilling port 603 is for providing a drilling fluid flow, the second injection port 604 is adapted for a high pressure (between 10 to 30 Bar) injection fluid flow to push the piston 451 into the body of the canister 7 to inject the substances into the self-drilling rock bolt assembly 1. The first drilling port 603 allows, for example, water to either: enter the canister 7 and pass through it via a tube or bypass the canister and enter the base of the nozzle 452, as shown in FIGS. 15 and 16. The nozzle 452, which is in connection with the hollow tube of the bolt, then provides water for drilling the hole (for flushing cuttings and cooling the drill bit). A sequencing valve 605 placed at the base of the receptacle 601 receives either a low-pressure and a high-pressure water flow and is configured, in a drilling configuration, to divert the low water pressure to the first drilling port 603 and, in a injection configuration, provide the high water pressure to the base of the internal body of the receptacle 601. The sequencing valve 605 is configured to switch between the drilling and injection configuration based on whether the water flow received is the low-pressure water flow or the high-pressure water flow.

As further shown in FIG. 16, a spindle 606 is provided to allow the lid 607 to be raised a distance to clear the nozzle 652, after a lock 608 is released, and then be rotated about the spindle axis clear of the receptacle void. The spent canister 7 can then be removed, and a new canister 7 inserted into the receptacle 601. A self-locating cam (not shown) on the spindle 606 ensures that the lid 607 may only be closed/lowered onto the receptacle body at a predetermined safe location to avoid damaging the nozzle 452. The lid 607 and the main body of the receptacle 601 interlock via a teething/lug arrangement 609 that allows the drill head rotational torque to be transferred to a drilling drive 610 of the self-drilling rock bolt assembly 1. The receptacle 601 thus facilitates quick unload of a spent canister 7 following ejection of the substances, and quick re-load of a fully charged canister 7.

The invention claimed is:

1. An injection system for a self-drilling rock bolt assembly, the system including:

a receptacle to be fixed in use to a drill head of the self-drilling rock bolt assembly, the receptacle having a nozzle receiving end and an opening at the other end;

a replaceable canister to be located within said receptacle in use, said canister adapted to supply two or more substances for use in installing the rock bolt assembly through said nozzle receiving end; and a piston system operatively associated with said receptacle adjacent said opening at said other end and positioned along a longitudinal axis of the drill head; the piston system including two or more pistons that are activated in use to drive the substances within the canister when located within the receptacle, delivering the substances by way of a nozzle mounted to the nozzle receiving end into the self-drilling rock bolt assembly.

2. The injection system of claim 1, wherein the canister includes an injection nozzle cap extending therefrom along the axis, the injection nozzle adapted to engage with a self-drilling rock bolt in use.

3. The injection system of claim 2, wherein between the nozzle cap and the main body are bristles or radial fins that function to join the nozzle cap to the main body, and also provide a water passage between the nozzle cap and the main body of the canister.

4. The injection system of claim 1, wherein, once the pistons are driven a desired distance along the axis into the canister, the pistons are retracted away from the nozzle to a start position.

5. The injection system of claim 1, wherein the pistons are driven mechanically or electrically.

6. The injection system of claim 5, wherein the pistons are driven by a water or oil pressure supplied adjacent the drill head.

7. The injection system of claim 1, wherein the chemicals in the canister are separated by solid tubes and/or membranes until the piston system is activated to drive the substances into the self-drilling rock bolt.

8. The injection system of claim 1, wherein the pistons are independently and/or simultaneously operable so that a flow of each substance is independently controllable.

9. The injection system of claim 1, wherein the canister includes compartments housing said different chemicals, a ratio and volume of substances dispensed is controlled by a geometry of said compartments and by actions of the corresponding pistons.

10. The injection system of claim 1, wherein the nozzle delivers both drilling flushing water as well as dispensing the substances.

11. The injection system of claim 1, wherein the canister is insertable and/or removable from said receptacle by rotation and/or sliding of an end portion of the receptacle where the piston system meets the receptacle remote to said nozzle.

12. The injection system of claim 1, wherein the canister is insertable and/or removable from said receptacle by lifting and/or rotation and/or sliding of a lid covering the receptacle adjacent said nozzle, and subsequent movement of the canister relative to the receptacle out of a top opening previously covered by the lid.

13. The injection system of claim 1, wherein each canister includes longitudinal fins on an outside surface that function to centralize the main body of the canister within the receptacle.

14. The injection system of claim 13, wherein the longitudinal fins are adapted to act as spacers between the canister and the receptacle to allow balanced and equalized water flow around the canister within the receptacle, when drilling a hole.

15. The injection system of claim 1, wherein the injection system further includes a valve configurable between a drilling configuration and an injection configuration, wherein, in the drilling configuration, the valve provides a drilling fluid flow through a passage between the canister and the receptacle to assist with drilling of the self-drilling rock bolt; and wherein, in the injection configuration, the valve provides an injection fluid flow to provide a fluid pressure for driving the piston system for delivering the substances for installing the self-drilling rock bolt.

16. The injection system of claim 15, wherein the drilling fluid flow is a low pressure fluid flow and the injection fluid flow is a high pressure fluid flow.

* * * * *